US008162073B2

(12) United States Patent
Krondorfer et al.

(10) Patent No.: US 8,162,073 B2
(45) Date of Patent: Apr. 24, 2012

(54) NAILER WITH BRUSHLESS DC MOTOR

(75) Inventors: Harald Krondorfer, Glenwillow, OH (US); John DeCicco, Elmhurst, IL (US); Eric Hlinka, Roselle, IL (US)

(73) Assignee: Robert Bosch GmbH, Stuttgart (DE)

( * ) Notice: Subject to any disclaimer, the term of this patent is extended or adjusted under 35 U.S.C. 154(b) by 179 days.

(21) Appl. No.: 12/389,430

(22) Filed: Feb. 20, 2009

(65) Prior Publication Data

US 2010/0213232 A1 Aug. 26, 2010

(51) Int. Cl.
*B65B 1/06* (2006.01)

(52) U.S. Cl. ..... 173/1; 227/131; 227/134

(58) Field of Classification Search ..... 227/8, 120, 227/129, 131, 132, 134, 135, 6, 7; 173/1, 173/2, 11

See application file for complete search history.

(56) References Cited

U.S. PATENT DOCUMENTS

| | | | | | |
|---|---|---|---|---|---|
| 3,581,855 | A | * | 6/1971 | Taeffner et al. | 192/18 B |
| 4,121,745 | A | * | 10/1978 | Smith et al. | 227/8 |
| 4,161,272 | A | * | 7/1979 | Brockl | 227/131 |
| 4,189,080 | A | | 2/1980 | Smith et al. | |
| 4,204,622 | A | | 5/1980 | Smith et al. | |
| 4,363,984 | A | | 12/1982 | Torii et al. | |
| 4,529,900 | A | | 7/1985 | Uzuka | |
| 4,807,793 | A | * | 2/1989 | Ghibely | 227/131 |
| 4,882,511 | A | * | 11/1989 | von der Heide | 310/67 R |
| 5,320,270 | A | * | 6/1994 | Crutcher | 227/131 |
| 5,723,923 | A | | 3/1998 | Clagett | |
| 5,894,095 | A | * | 4/1999 | DeMali | 73/862.27 |
| 6,369,532 | B2 | * | 4/2002 | Koenen et al. | 318/150 |
| 6,669,072 | B2 | * | 12/2003 | Burke et al. | 227/131 |
| 6,794,777 | B1 | | 9/2004 | Fradella | |
| 6,971,567 | B1 | * | 12/2005 | Cannaliato et al. | 227/2 |
| 7,325,711 | B2 | * | 2/2008 | Schiestl et al. | 227/131 |
| 7,494,036 | B2 | * | 2/2009 | Shima et al. | 227/131 |
| 7,575,142 | B2 | * | 8/2009 | Liang et al. | 227/133 |
| 2005/0242154 | A1 | * | 11/2005 | Leimbach | 227/131 |
| 2007/0210134 | A1 | * | 9/2007 | Oda et al. | 227/131 |
| 2007/0267990 | A1 | * | 11/2007 | Abolhassani et al. | 318/432 |
| 2008/0073405 | A1 | * | 3/2008 | Shima et al. | 227/131 |
| 2008/0173458 | A1 | * | 7/2008 | Seith et al. | 173/176 |
| 2009/0032566 | A1 | * | 2/2009 | Liang et al. | 227/131 |
| 2009/0032567 | A1 | * | 2/2009 | Liang et al. | 227/131 |

OTHER PUBLICATIONS

Five page printout from Wikipedia website entitled "Brushless DC Electric Motor".

One page printout from Wikipedia website entitled "Outrunner".

Texas Instruments, "Linear Products, TPIC43T01 Application Brief," Mar. 1998, Copyright 1998, Texas Instruments Inc. (9 pages).

* cited by examiner

*Primary Examiner* — Paul Durand

(74) *Attorney, Agent, or Firm* — Maginot, Moore & Beck

(57) ABSTRACT

A device for impacting a fastener in one embodiment includes a drive mechanism configured to impact a fastener, a lever arm pivotable between a first position and a second position, and a motor including a plurality of permanent magnets mounted on a rotatable housing, the motor mounted on the lever arm such that when the lever arm is in the first position, the rotatable motor housing is isolated from the drive mechanism and when the lever arm is in the second position, the rotatable motor housing is positioned to transfer rotational energy to the drive mechanism.

19 Claims, 7 Drawing Sheets

NAILER WITH BRUSHLESS DC MOTOR

Cross-reference is made to U.S. Utility patent application Ser. No. 12/191,935 entitled "Cordless Nail Gun" by Krondorfer et al., which was filed on Aug. 14, 2008; to U.S. Utility patent application Ser. No. 12/191,948 entitled "Cordless Nailer With Safety Sensor" by Krondorfer et al., which was filed on Aug. 14, 2008; to U.S. Utility patent application Ser. No. 12/191,960 entitled "Cordless Nailer With Safety Mechanism" by Krondorfer et al., which was filed on Aug. 14, 2008; and to U.S. Utility patent application Ser. No. 12/191,979 entitled "Cordless Nailer Drive Mechanism Sensor" by Hlinka et al., which was filed on Aug. 14, 2008, the entirety of each of which is incorporated herein by reference.

FIELD OF THE INVENTION

This invention relates to the field of devices used to drive fasteners into work-pieces and particularly to a device for impacting fasteners into work-pieces.

BACKGROUND

Fasteners such as nails and staples are commonly used in projects ranging from crafts to building construction. While manually driving such fasteners into a work-piece is effective, a user may quickly become fatigued when involved in projects requiring a large number of fasteners and/or large fasteners. Moreover, proper driving of larger fasteners into a work-piece frequently requires more than a single impact from a manual tool.

In response to the shortcomings of manual driving tools, power-assisted devices for driving fasteners into wood have been developed. Contractors and homeowners commonly use such devices for driving fasteners ranging from brad nails used in small projects to common nails which are used in framing and other construction projects. Compressed air has been traditionally used to provide power for the power-assisted devices. Specifically, a source of compressed air is used to actuate a cylinder which impacts a nail into the work-piece. Such systems, however, require an air compressor, increasing the cost of the system and limiting the portability of the system. Additionally, the air-lines used to connect a device to the air compressor hinder movement and can be quite cumbersome and dangerous in applications such as roofing.

Fuel cells have also been developed for use as a source of power for power-assisted devices. The fuel cell is generally provided in the form of a cylinder which is removably attached to the device. In operation, fuel from the cylinder is mixed with air and ignited. The subsequent expansion of gases is used to push the cylinder and thus impact a fastener into a work-piece. These systems are relatively complicated as both electrical systems and fuel systems are required to produce the expansion of gases. Additionally, the fuel cartridges are typically single use cartridges.

Another source of power that has been used in power assisted devices is electrical power. Traditionally, electrical devices have been mostly limited to use in impacting smaller fasteners such as staples, tacks and brad nails. In these devices, a solenoid driven by electrical power from an external source is used to impact the fastener. The force that can be achieved using a solenoid, however, is limited by the physical structure of the solenoid. Specifically, the number of ampere-turns in a solenoid governs the force that can be generated by the solenoid. As the number of turns increases, however, the resistance of the coil increases necessitating a larger operational voltage. Additionally, the force in a solenoid varies in relation to the distance of the solenoid core from the center of the windings. This limits most solenoid driven devices to short stroke and small force applications such as staplers or brad nailers.

Various approaches have been used to address the limitations of electrical devices. In some systems, multiple impacts are used. This approach requires the tool to be maintained in position for a relatively long time to drive a fastener. Another approach is the use of a spring to store energy. In this approach, the spring is cocked (or activated) through an electric motor and gearbox. Once sufficient energy is stored within the spring, the energy is released from the spring into an anvil which then impacts the fastener into the substrate. The force delivery characteristics of a spring, however, are not well suited for driving fasteners. As a fastener is driven further into a work-piece, more force is needed. In contrast, as a spring approaches an unloaded condition, less force is delivered to the anvil.

Flywheels have also been used to store energy for use in impacting a fastener. The flywheels are used to launch a hammering anvil that impacts the nail. A shortcoming of such designs is the manner in which the flywheel is coupled to the driving anvil. Some designs incorporate the use of a friction clutching mechanism that is both complicated, heavy and subject to wear. Other designs use a continuously rotating flywheel coupled to a toggle link mechanism to drive a fastener. Such designs are limited by large size, heavy weight, additional complexity, and unreliability.

Power-assisted impacting tools incorporate a motor to provide the energy which is used to impact a fastener. The motor is typically a motor which incorporates brushes. Brushed motors are effective for generating a rotational torque from a direct current power source. Brushed motors, however, occupy a large amount of space, resulting in a bulky tool. Moreover, the brushed motors are relatively heavy and inefficient. Additionally, brushed motors generate sparks which are not desired in dusty environments and the brushed motors are relatively inefficient. Lastly, a brushed motor requires a speed reducing mechanism (i.e. belt or gearbox) that couples the armature shaft to the flywheel in order to provide the necessary torque to accelerate the flywheel.

What is needed is an energy storage system which can be used to control delivery of impacting force in a device which is reliable and safe and does not increase the number of mechanical switches. What is needed is a system which can be used to provide impacting force in a device using low voltage energy sources. What is further needed is a system which is reliable and does not require a continuously rotating flywheel. A further need exists for a device which exhibits improved efficiency, and which is lighter, or smaller, or quieter than a tool incorporating a brushed motor.

SUMMARY

In accordance with one embodiment, there is provided a device for impacting a fastener which includes a drive mechanism configured to impact a fastener, a lever arm pivotable between a first position and a second position, and a motor including a plurality of permanent magnets mounted on a rotatable housing, the motor mounted on the lever arm such that when the lever arm is in the first position, the rotatable motor housing is isolated from the drive mechanism and when the lever arm is in the second position, the rotatable motor housing is positioned to transfer rotational energy to the drive mechanism.

In accordance with another embodiment, a method of impacting a fastener includes energizing a motor including a plurality of permanent magnets, rotating a housing using the plurality of permanent magnets, engaging the rotating housing and a drive mechanism, and transferring energy from the rotating housing to the drive mechanism.

In accordance with a further embodiment, a device for impacting a fastener includes a frame, a lever arm pivotably mounted to the frame, an outrunner motor mounted to the lever arm, a drive mechanism for impacting a fastener, and a solenoid configured to pivot the lever arm between a first position wherein rotational energy from the outrunner motor is isolated from the drive mechanism and a second position wherein rotational energy from the outrunner motor can transfer to the drive mechanism.

DESCRIPTION

Figure 1:
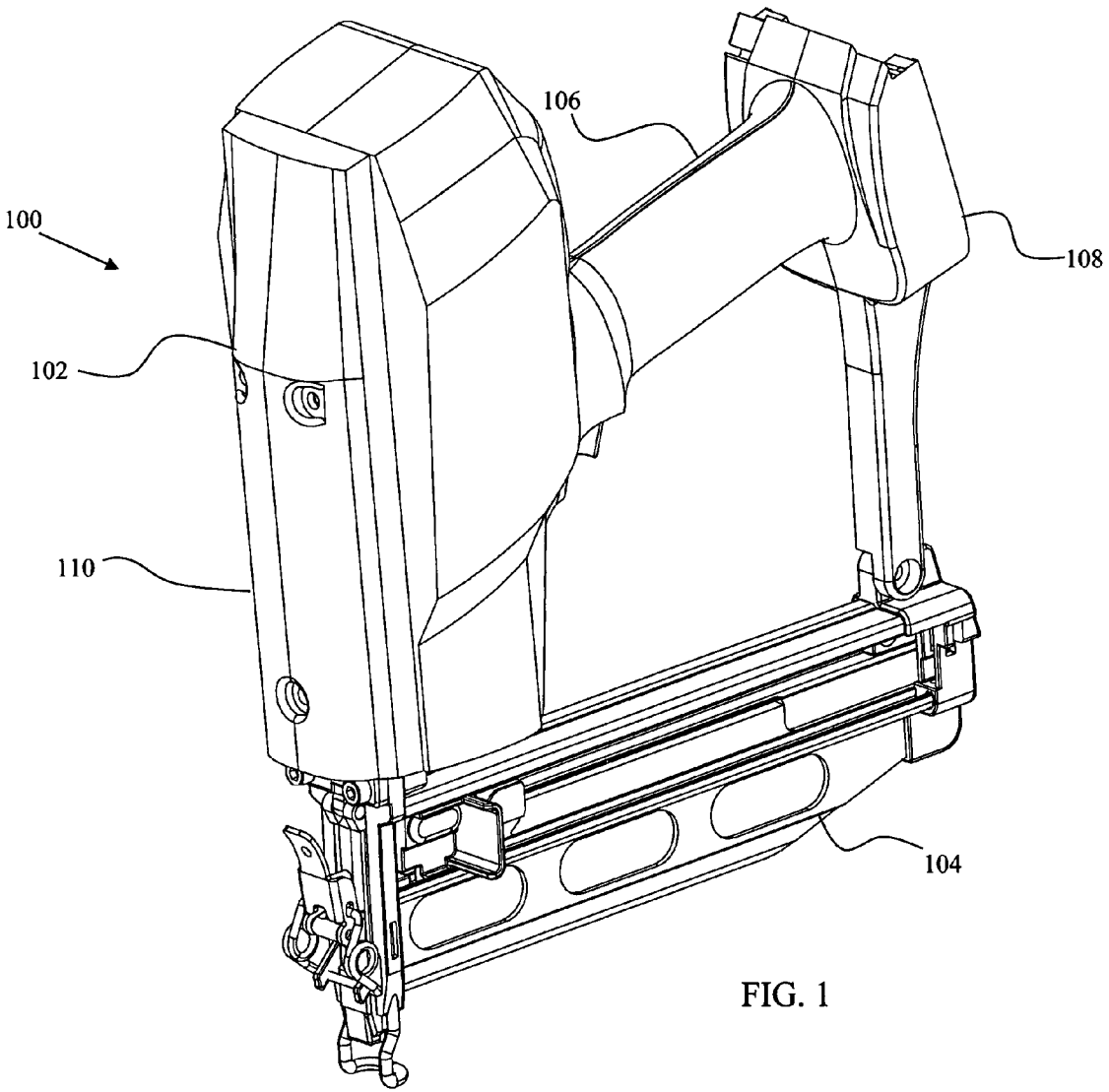
FIG. 1 depicts a front perspective view of a fastener impacting device in accordance with principles of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
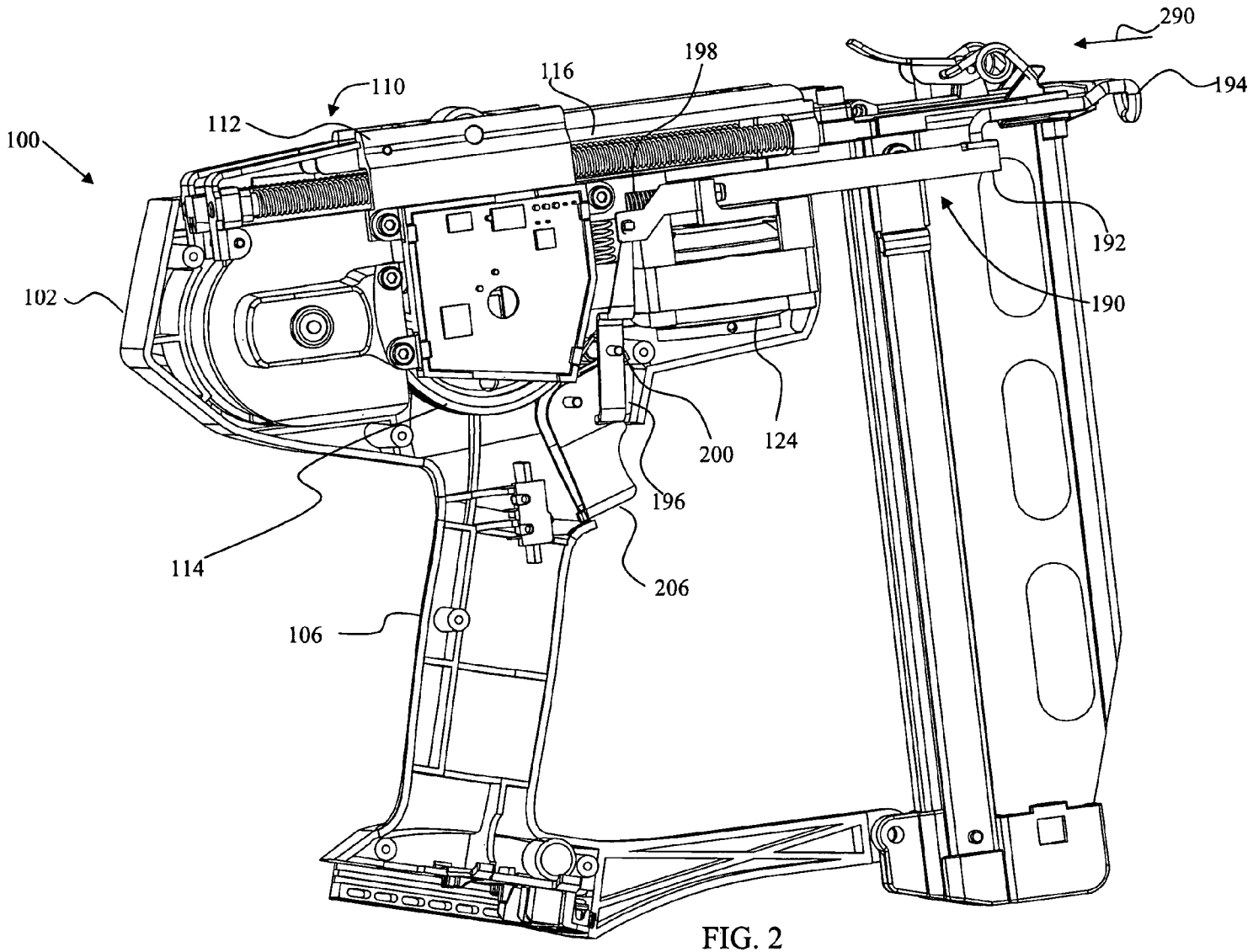
FIG. 2 depicts a side plan view of the fastener impacting device of FIG. 1 with a portion of the housing removed.
Figure 3:
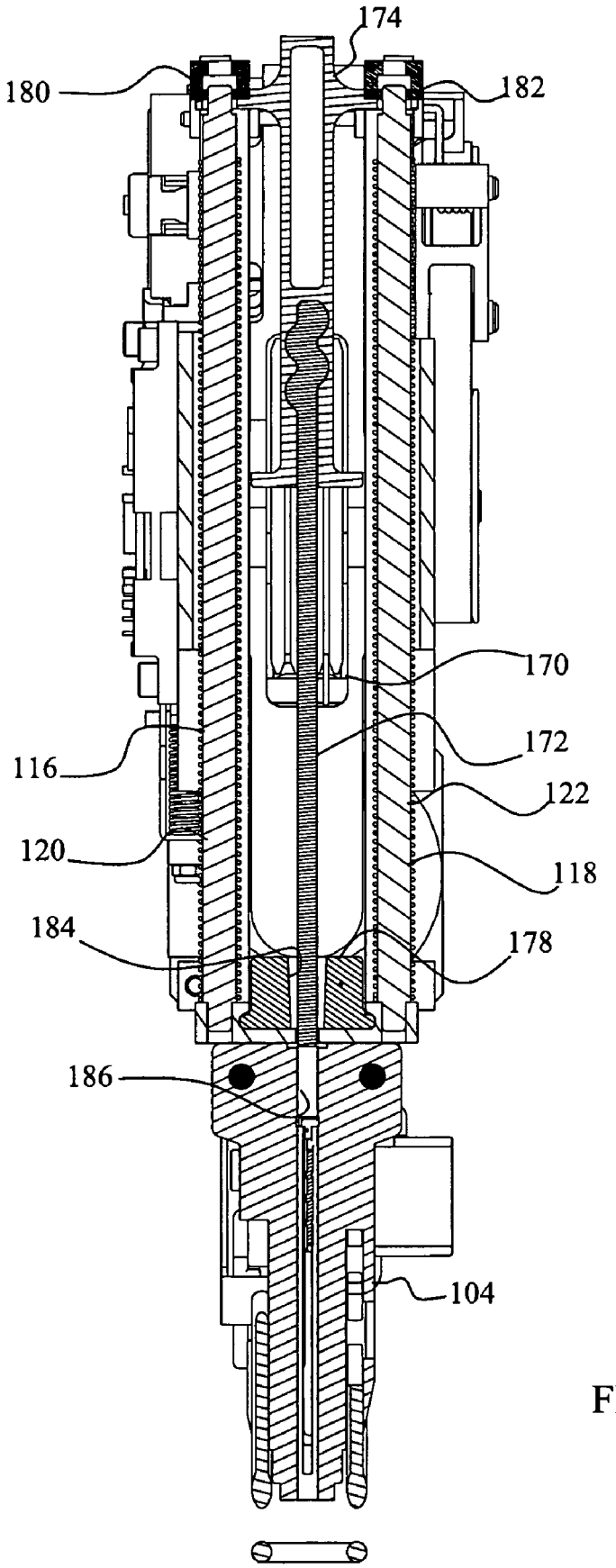
FIG. 3 depicts a top cross sectional view of the fastener impacting device of FIG. 1.

FIG. 1 depicts a fastener impacting device 100 including a housing 102 and a fastener cartridge 104. The housing 102 defines a handle portion 106, a battery receptacle 108 and a drive section 110. The fastener cartridge 104 in this embodiment is spring biased to force fasteners, such as nails or staples, serially one after the other, into a loaded position adjacent the drive section 110. With further reference to FIG. 2, wherein a portion of the housing 102 is removed, the housing 102 is mounted on a two piece frame 112 which supports a brushless direct current motor 114. Two springs 116 and 118, shown more clearly in FIG. 3, are positioned about guides 120 and 122, respectively. A solenoid 124 is located below the guides 120 and 122.

Figure 4:
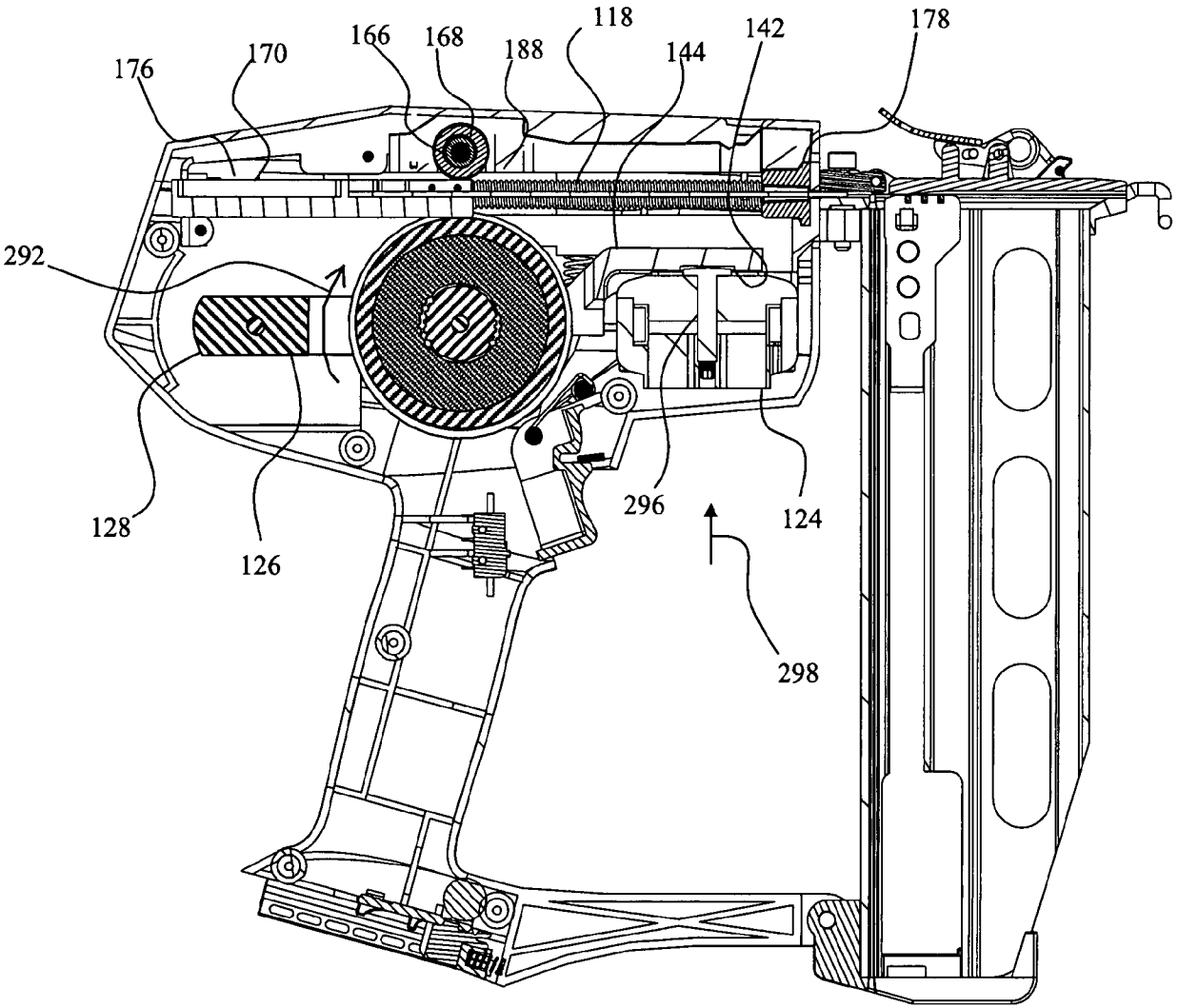
FIG. 4 depicts a side cross sectional view of the fastener impacting device of FIG. 1.

The motor 114 is mounted on a lever arm assembly 126 as shown in FIG. 4. The lever arm assembly 126, also shown in FIG. 5, includes a base 128 with a pivot pin 130, a motor bracket 132, two spring wells 134 and 136 which receive springs 138 and 140, respectively, and a pin receiving recess 142, which is best seen in FIG. 4, located on the lower surface of a tongue 144.

Figure 6:
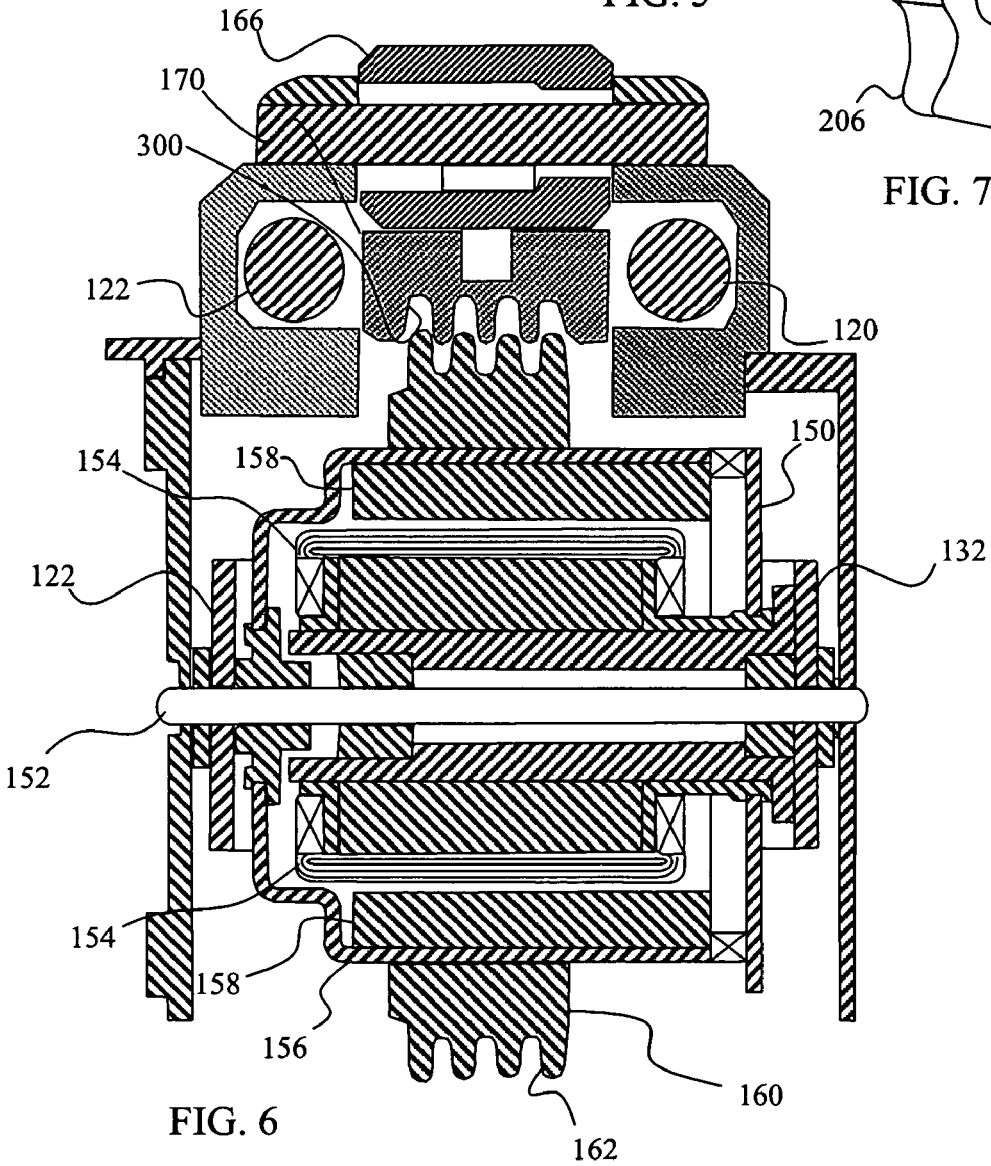
FIG. 6 depicts a rear cross sectional view of the lever arm assembly of the device of FIG. 1.

The motor 114 is supported by the motor bracket 132. The motor 114 in one embodiment is an outrunner motor. Thus, as shown in FIG. 6, the motor 114 is mounted to the motor bracket 132 by a mounting plate 150 on one side and by a support shaft 152, through which wiring for the motor 114 may be provided, on the opposite side. Stator windings 154 are wound around a core which is mounted to the support shaft 152. A rotor housing 156 is rotatably supported by the support shaft 152. Rotor magnets 158 are fixed to the inner surface of the rotor housing 156 and a drive wheel 160 is mounted to the outer surface of the rotor housing 156. The drive wheel may also be part of the housing structure rather than a separate part. A plurality of grooves 162 are formed in the outer periphery of the drive wheel 160.

Continuing with FIGS. 3 and 4, a free-wheeling roller 166 is rigidly mounted to the frame 112 through a bearing 168 at a location above a drive member 170. The drive member 170 includes an anvil 172 at one end and a guide rod flange 174 at the opposite end. A permanent magnet 176 is also located on the drive member 170. The drive member 170 is movable between a front bumper 178 located at the forward end portions of the guides 120 and 122 and a pair of rear bumpers 180 and 182 located at the opposite end portions of the guides 120 and 122. The front bumper 178 defines a central bore 184 which opens to a drive channel 186 in the fastener cartridge 104. A Hall Effect sensor 188 is located forward of the free wheeling roller 166.

Referring to FIG. 2, an actuating mechanism 190 includes a slide bar 192 which is connected at one end to a work contact element (WCE) 194 and at the opposite end to a pivot arm 196. A spring 198 biases the slide bar 192 toward the WCE 194. The pivot arm 196 pivots about a pivot 200 and includes a hook portion 202 shown in FIG. 7. The hook portion 202 is configured to fit within a stop slot 204 of a trigger 206. The trigger 206 pivots about a pivot 208 and is aligned to activate a spring loaded switch 210.

Figure 8:
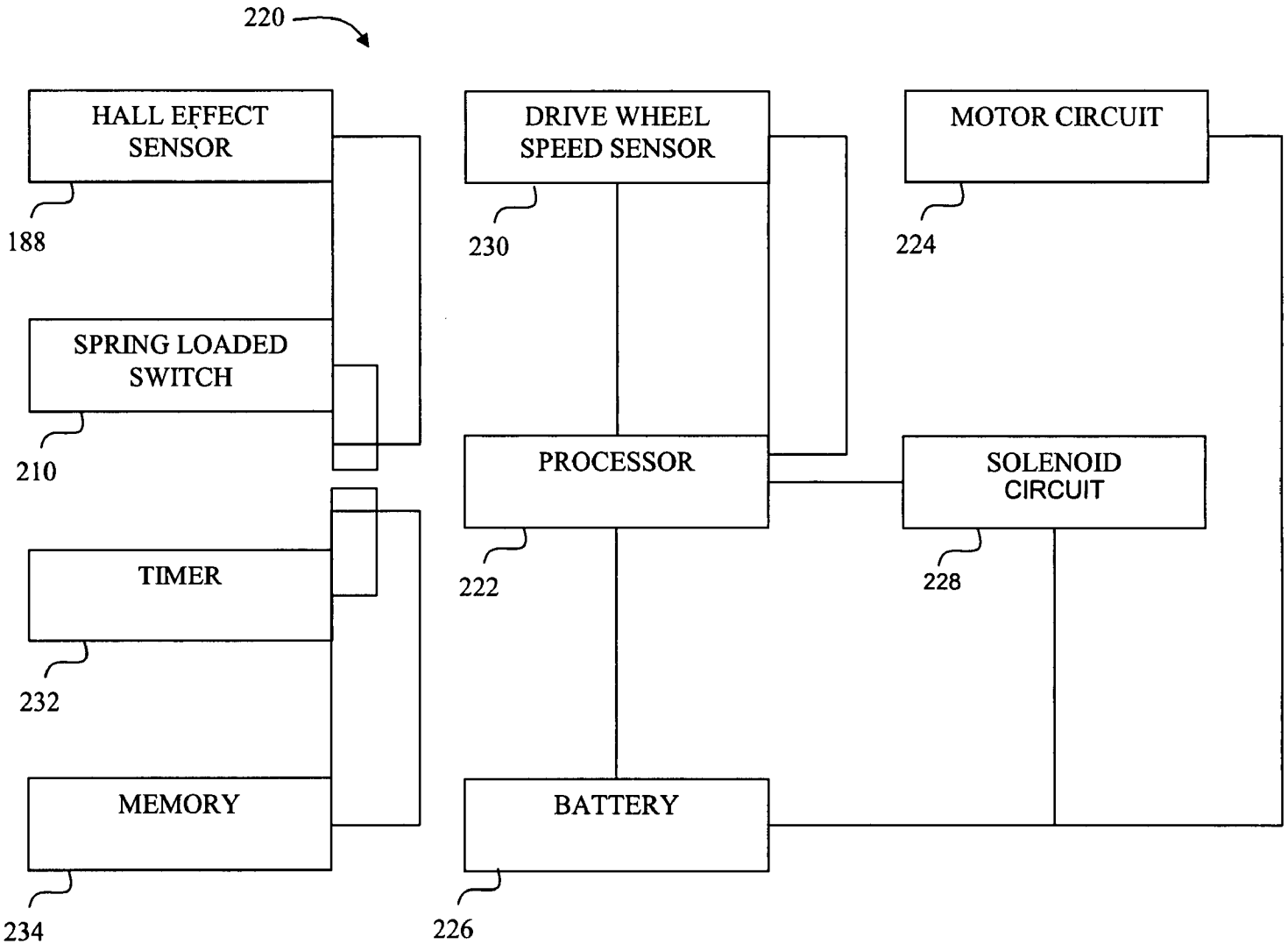
FIG. 8 depicts a schematic of a control system used to control the device of FIG. 1 in accordance with principles of the invention.

The spring loaded switch 210 is used to provide input to a control circuit 220 shown in FIG. 8. The control circuit 220 includes a processor 222 that controls the operation of the motor 114 through a motor circuit 224 and the solenoid 124 through a solenoid circuit 228. Power to the circuit 220 as well as the motor 114 and the solenoid circuit 228 is provided by a battery 226 coupled to the battery receptacle 108 (see FIG. 1). The processor 222 receives signal inputs from the spring loaded switch 210, the Hall Effect sensor 188, and a drive wheel speed sensor 230. The control circuit 220 further includes a timer 232 which provides input to the processor 222. A memory 234 is programmed with command instructions which, when executed by the processor 222, provide performance of various control functions described here. In one embodiment, the processor 222 and the memory 234 are onboard a microcontroller.

Figure 9:
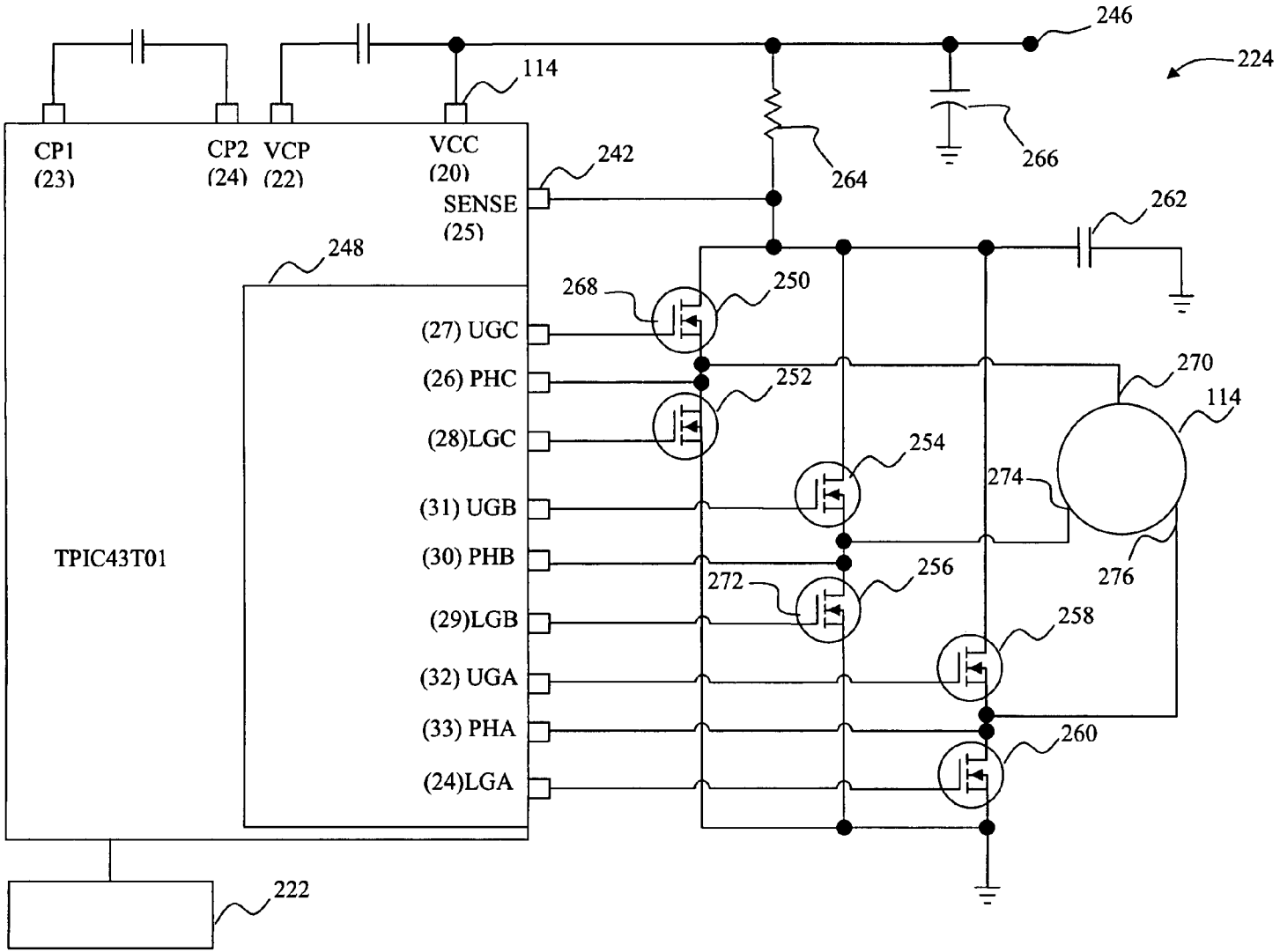
FIG. 9 depicts a schematic of a motor control system used to control the brushless motor of FIG. 1 in accordance with principles of the invention.

A schematic diagram of the motor circuit 224 is shown in FIG. 9. The motor circuit 224, which is powered through power input 246, in one embodiment is a model TPIC43T01 motor controller commercially available from Texas Instruments, Inc. of Dallas, Tex.

The motor circuit 224 includes an FET driver portion 248. The driver portion 248 is connected through NMOS FETs 250, 252, 254, 256, 258, and 260 to the motor 114. A capacitor 262 is connected to the drains of the high side NMOS transistors 250, 254, and 258.

Rotation of the motor 114 is accomplished by activating the trigger 206 to apply power to the power input 246. The application of power further completes a circuit allowing current to flow through a sensor resistor 264.

More specifically, the NMOS FETs 250 and 256 are controlled as a pair by the driver portion 248 to produce a single phase of power to the motor 114. When a signal is presented to the gate 268 of the NMOS FET 250, the NMOS FET 250 couples the motor terminal 270 to battery power. When a signal is presented to the gate 272 of NMOS FET 256, the NMOS FET 256 couples the motor terminal 274 to ground, allowing current to flow and causing the motor to rotate.

Similarly, the NMOS FETs 254 and 260 are controlled as a pair to provide a second phase of power to the terminal 274 of the motor 114 and the NMOS FETs 258 and 252 are controlled as a pair to provide a third phase of power to the terminal 276 of the motor 114. Thus, the NMOS FETs 250, 252, 254, 256, 258, and 260 are configured as a three pair half bridge, which are controlled by the motor circuit 224 to provide three phase power to the motor 114.

When rotation of the motor 114 is no longer desired, the trigger 206 may be released, thereby removing power from the motor circuit 224.

Further detail and operation of the fastener impacting device 100 is described with initial reference to FIGS. 1-8. When the battery 226 is inserted into the battery receptacle 108 power is applied to the control circuit 220. Next, the operator presses the work contact element 194 against a work-piece, pushing the work contact element 194 in the direction of the arrow 290 shown in FIG. 2. The movement of the work contact element 194 causes the slide bar 192 of the actuating mechanism 190 to compress the spring 198 and to pivot the pivot arm 196 about the pivot pin 200.

As the pivot arm 196 pivots about the pivot pin 200, the hook portion 202 of the pivot arm 196 rotates out of the stop slot 204. This allows the trigger 206 to be moved toward the spring loaded switch 210 shown in FIG. 7. As the trigger 206 presses against the spring loaded switch 210, a signal is generated and sent to the processor 222. In response to the signal, the processor 222 causes energy from the battery 226 to be provided to the motor 114 through the motor circuit 224 causing the rotor housing 156 of the motor 114 to rotate in the direction of the arrow 292 of FIG. 4. Accordingly, the drive wheel 160, which is fixedly attached to the rotor housing 156, also rotates in the direction of the arrow 292.

The rotation of the drive wheel 160 is sensed by the drive wheel speed sensor 230 and a signal indicative of the rotational speed of the drive wheel 160 is passed to the processor 222. The processor 222 controls the motor 114 to increase the rotational speed of the drive wheel 160 until the signal from the drive wheel speed sensor 230 indicates that a sufficient amount of kinetic energy has been stored in the drive wheel 160.

In response to achieving a sufficient amount of kinetic energy, the processor 222 causes the supply of energy to the motor 114 to be interrupted, allowing the motor 114 to be freely rotated by energy stored in the rotating drive wheel 160. The processor 222 further starts the timer 232 and controls the solenoid circuit 228 to power the solenoid 124 whereby a pin 296 is forced outwardly from the solenoid 124 in the direction of the arrow 298 shown in FIG. 4, and against the pin receiving recess 142.

The pin 296 thus forces the springs 138 and 140 to be compressed within the spring wells 134 and 136. As the springs 138 and 140 are compressed by the expulsion of the pin 296, the lever arm assembly 126 rotates about the pivot pin 130 in the direction of the arrow 298 of FIG. 5 since the lever arm 126 is rotatably connected to the frame 112 through the pivot pin 130.

Rotation of the lever arm 126 forces the grooves 162 of the drive wheel 160 into complimentary grooves 300 of the drive member 170 shown in FIG. 6. Accordingly, the drive member 170 is pinched between the freewheeling roller 166 and the drive wheel 160. The drive wheel 160 transfers energy to the drive member 170 and the flange 174, which is configured to abut the springs 116 and 118, presses against the springs 116 and 118, overcoming the bias of the springs 116 and 118 and forcing the drive member 170 toward the front bumper 178. While the embodiment of FIG. 1 incorporates springs, other embodiments may incorporate other resilient members in place of or in addition to the springs 116 and 118. Such resilient members may include tension springs or elastomeric materials such as bungee cords or rubber bands.

If desired, the motor and drive wheel may be mounted to the device housing rather than mounted on a pivot arm. In such embodiments, rotational energy from the motor housing may be transferred by movement of a drive mechanism into contact with the motor housing, such as by mounting the drive mechanism on a pivoting arm.

Continuing with the example, movement of the drive member 170 along the drive path moves the anvil 172 into the drive channel 186 through the central bore 184 of the front bumper 178 so as to impact a fastener located adjacent to the drive section 110.

Movement of the drive member 170 continues until either a full stroke has been completed or until the timer 232 has timed out. Specifically, when a full stroke is completed, the permanent magnet 176 is located adjacent to the Hall Effect sensor 188 (see FIG. 4). The sensor 188 thus senses the presence of the magnet 176 and generates a signal which is received by the processor 222. In response to the first of a signal from the sensor 188 or timing out of the timer 232, the processor 222 is programmed to interrupt power to the solenoid circuit 228.

In alternative embodiments, the Hall Effect sensor may be replaced with a different sensor. By way of example, an optical sensor, an inductive/proximity sensor, a limit switch sensor, or a pressure sensor may be used to provide a signal to the processor 222 that the drive member 170 has reached a full stroke. Depending upon various considerations, the location of the sensor may be modified. For example, a pressure switch may be incorporated into the front bumper 178. Likewise, the component of the drive member 170 which is sensed, such as the magnet 176, may be positioned at various locations on the drive member 170. Additionally, the sensor may be configured to sense different components of the drive member 170 such as the flange 174 or the anvil 172.

Figure 5:
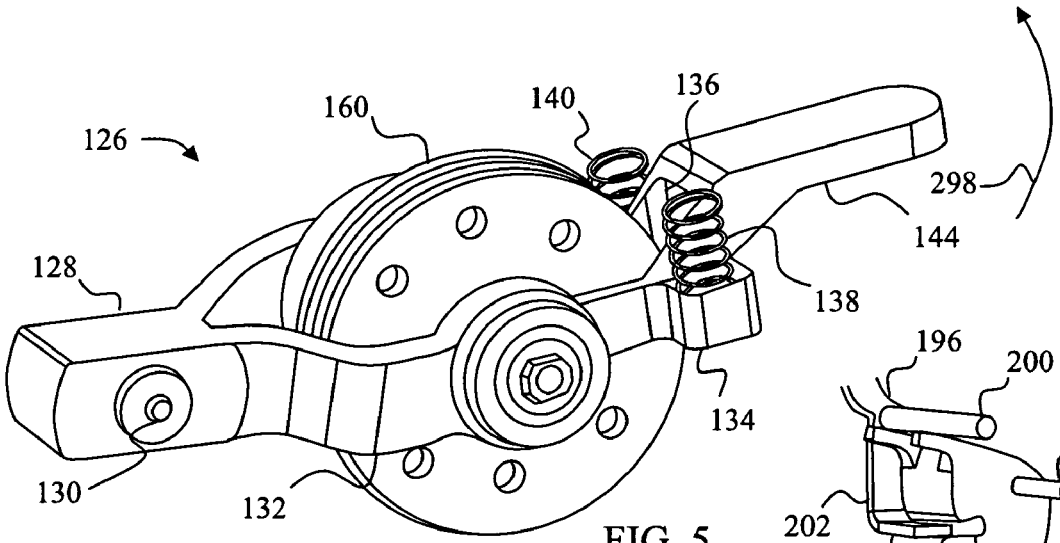
FIG. 5 depicts a side perspective view of the lever arm assembly of the device of FIG. 1.

De-energization of the solenoid 124 allows the pin 296 to move back within the solenoid 124 as the energy stored within the springs 138 and 140 causes the springs 138 and 140 to expand thereby rotating the lever arm 126 in the direction opposite to the direction of the arrow 298 (see FIG. 5). The drive wheel 160 is thus moved away from the drive member 170. When movement of the drive member 170 is no longer influenced by the drive wheel 160, the bias provided by the springs 116 and 118 against the flange 174 causes the drive member 170 to move in a direction toward the rear bumpers 180 and 182. The rearward movement of the drive member 170 is arrested by the bumpers 180 and 182.

The solenoid 124 and lever arm 126 are thus returned to the condition shown in FIG. 4. In this embodiment, the signal from the trigger switch 210 must be interrupted by releasing the trigger 206 prior to re-energizing the motor 114 to initiate another impacting sequence.

Figure 7:
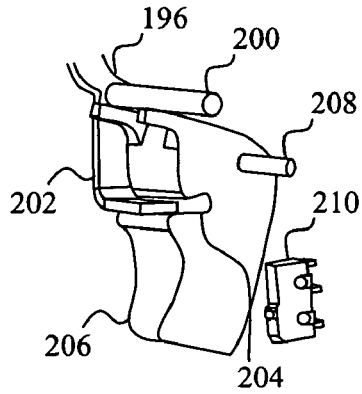
FIG. 7 depicts a partial perspective view of the device of FIG. 1 showing a trigger, a trigger sensor switch and a hook portion of a lever arm which can inhibit rotation of the trigger.

Returning to the embodiment of FIG. 1, in the event that the fastener impacting device 100 is moved away from the workpiece after a fastener has been impacted and the trigger 206 has been released, the spring 198 forces the actuating mechanism 190 to return to the position shown in FIG. 2. In this position, the hook portion 202 of the pivot arm 196 is positioned within the stop slot 204 of the trigger 206 as shown in FIG. 7. In the configuration of FIG. 7, the hook portion 202 prevents movement of the trigger 206 against the spring switch 210. Accordingly, a fastener cannot be impacted before first pressing the WCE 194 against a work piece to allow operation in the manner described above.

In alternative embodiments, the processor 222 can accept a trigger input associated with the trigger 206 and a WCE input associated with the WCE 194. The trigger input and the WCE input may be provided by switches, sensors, or a combination of switches and sensors. In one embodiment, the WCE 194 no longer needs to interact with the trigger 206 via an actuating mechanism 190 including a pivot arm 196 and a hook portion 202. Rather, the WCE 194 interacts with a switch (not shown) that sends a signal to the processor 222 that indicates when the WCE 194 has been depressed. The WCE 194 may also be configured to be sensed rather than to be engaged with a switch. The sensor (not shown) may be an optical sensor, an inductive/proximity sensor, a limit switch sensor, or a pressure sensor.

In this alternative embodiment, the trigger switch can include a sensor that detects the position of the trigger. This alternative embodiment can operate in two different firing modes, which is user selectable by a mode selection switch (not shown). In a sequential operating mode, depression of the WCE 194 causes a WCE signal, based upon a switch or a sensor, to be generated. In response, the processor 222 executes program instructions causing battery power to be provided to the motor 114. The processor 222 may also energize the sensor 210 based upon the WCE signal. When the drive wheel speed sensor 230 indicates a desired amount of kinetic energy has been stored in the drive wheel 160, the processor 222 then controls the motor 114 to maintain the rotational speed of the drive wheel 160 that corresponds to the kinetic energy desired.

If desired, an operator may be alerted to the status of the kinetic energy available. By way of example, the processor 222 may cause a red light (not shown) to be energized when the rotational speed of the drive wheel 160 is lower than the desired speed and the processor 222 may cause a green light (not shown) to be energized when the rotational speed of the drive wheel 160 is at or above the desired speed.

In addition to causing energy to be provided to the motor 114 upon depression of the WCE 194, the processor 222 starts a timer when battery power is applied to the motor 114. If a trigger signal is not detected before the timer times out, battery power will be removed from the motor 114 and the sequence must be restarted. The timer 232 may be used to provide a timing signal. Alternatively, a separate timer may be provided.

If the trigger 206 is manipulated, however, the processor 222 receives a trigger signal from the trigger switch 210 or a trigger sensor. The processor 222 then causes the supply of energy to the motor 114 to be interrupted, as long as the kinetic energy in the drive wheel 160 is sufficient, allowing the motor 114 to be freely rotated by energy stored in the rotating drive wheel 160. The processor 222 further starts the first timer 232 and controls the solenoid circuit 228 to power the solenoid 124. In response to the first of a signal from the driver block sensor 188 or timing out of the timer 232, the processor 212 is programmed to interrupt power to the solenoid circuit Both the WCE switch/sensor and the trigger switch or trigger sensor 206 must be reset before another cycle can be completed.

Alternatively, an operator may select a bump operating mode using a mode selection switch. In embodiments incorporating a trigger sensor, positioning of the selection switch in the bump mode setting causes the trigger sensor to be energized. In this mode of operation, the processor 222 will supply battery power to the motor 114 in response to either the WCE switch/sensor signal or the trigger switch/sensor signal. Upon receipt of the remaining input signal, the processor 222 verifies that the desired kinetic energy is stored in the drive wheel 160 and then causes the supply of power to the motor 114 to be interrupted and the battery power is supplied to the solenoid 124. In response to the first of a signal from the driver block sensor 188 or timing out of the timer 232, the processor 222 is programmed to interrupt power to the solenoid circuit 228.

In another embodiment, continued depression of the trigger 206 causes the motor 114 to be energized. Activation of the solenoid 124, however, is not allowed until the WCE 194 has been released and then pressed against a work piece. In this embodiment, called bump-mode, a sensor may be used to signal the condition of the WCE.

In bump operating mode, only one of the two inputs must be reset. The processor 222 will supply battery power to the motor 114 immediately after the solenoid power is removed as long as at least one of the inputs remains activated when the other input is reset. When the reset input again provides a signal to the processor 222, the sequence described above is once again initiated.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

The invention claimed is:

1. A method of impacting a fastener comprising:

energizing a motor including a plurality of permanent magnets;

rotating a housing of the motor using the plurality of permanent magnets;

deenergizing the motor;

engaging the rotating housing and a drive mechanism after deenergizing the motor; and transferring energy from the rotating housing to the drive mechanism with the rotating housing engaged with the drive mechanism and the motor deenergized.

2. The method of claim 1, wherein transferring energy comprises:

transferring energy from the rotating housing of a brushless motor to the drive mechanism through a drive wheel portion extending about the motor housing.

3. The method of claim 1, wherein transferring energy comprises:

engaging a plurality of axially extending grooves on the drive mechanism with a plurality of grooves extending circumferentially about the motor.

4. The method of claim 1, further comprising:

energizing a lever arm solenoid to pivot the drive mechanism toward the rotating housing.

5. The method of claim 1, further comprising:

energizing a lever arm solenoid to pivot the rotating housing toward the drive mechanism; and deenergizing the motor prior to energizing the lever arm solenoid.

6. The method of claim 1, further comprising:

moving a work contact element from a first position to a second position to enable a trigger prior to pivoting the rotating housing.

7. A device for impacting a fastener comprising:

a drive mechanism configured to impact a fastener;

a lever arm pivotable between a first position and a second position; and a motor (i) defining an axis of rotation, (ii) including at least one stator winding, and (iii) including a plurality of permanent magnets, the plurality of permanent magnets mounted on a rotatable housing, the housing rotatable about the axis of rotation and located outwardly of the at least one stator winding with respect to the axis of rotation, the motor mounted on the lever arm such that movement of the lever arm causes movement of the motor, and when the lever arm is in the first position, the rotatable motor housing is isolated from the drive mechanism and when the lever arm is in the second position, the rotatable motor housing is positioned to transfer rotational energy to the drive mechanism.

8. The device of claim 1, wherein the motor further comprises:

a drive wheel portion extending about the motor housing, the drive wheel portion configured to rotatably engage the drive mechanism.

9. The device of claim 8, wherein:

the drive wheel portion comprises a plurality of grooves extending circumferentially about the motor;

the motor is a brushless motor; and the drive mechanism comprises a plurality of axially extending grooves.

10. The device of claim 8, wherein the drive wheel portion is press-fit to the rotatable housing.

11. The device of claim 1, further comprising:

a lever arm solenoid configured to pivot the lever arm between the first position and the second position.

12. The device of claim 11, further comprising:

a memory including program instructions; and a processor operably connected to the memory for executing the program instructions to (i) energize the motor, and (ii) control the lever arm to pivot between the first position and the second position based upon movement of a trigger.

13. The device of claim 12, further comprising:

a work contact element (WCE) for disabling the trigger based upon the position of the WCE.

14. The device of claim 13, further comprising:

a trigger sensor assembly operably connected to the processor for generating a trigger signal indicative of the movement of the trigger.

15. The device of claim 1, further comprising:

a frame; and a solenoid configured to pivot the lever arm from the first position to the second position, wherein the lever arm is pivotably mounted to the frame; and the motor is an outrunner motor.

16. The device of claim 15, further comprising:

a drive wheel mounted to the outrunner motor.

17. The device of claim 15, the outrunner motor further comprising:

a rotatable housing; and a drive wheel integrally formed with the rotatable housing.

18. The device of claim 15, further comprising:

a drive wheel portion extending about the outrunner motor, the drive wheel portion configured to rotatably engage the drive mechanism.

19. The device of claim 18, wherein:

the drive wheel portion comprises a plurality of grooves extending circumferentially about the outrunner motor;

the outrunner motor is a brushless motor; and the drive mechanism comprises a plurality of axially extending grooves.

* * * * *

UNITED STATES PATENT AND TRADEMARK OFFICE

CERTIFICATE OF CORRECTION

PATENT NO. : 8,162,073 B2
APPLICATION NO. : 12/389430
DATED : April 24, 2012
INVENTOR(S) : Krondorfer et al.

It is certified that error appears in the above-identified patent and that said Letters Patent is hereby corrected as shown below:

On the Title Page at (75) Inventors:

Delete "Glenwillow" and insert --Aurora-- in its place.

Signed and Sealed this
Sixth Day of November, 2012

David J. Kappos

David J. Kappos
*Director of the United States Patent and Trademark Office*